United States Patent [19]

King

[11] 4,279,350

[45] Jul. 21, 1981

[54] CLOSURE WITH OXYGEN SCAVENGING SYSTEM

[75] Inventor: Roderick V. King, Girard, Pa.

[73] Assignee: Ethyl Corporation, Baton Rouge, La.

[21] Appl. No.: 83,977

[22] Filed: Oct. 11, 1979

[51] Int. Cl.[3] ..... B65D 51/24

[52] U.S. Cl. ..... 215/228; 215/261; 215/347; 206/204

[58] Field of Search ..... 215/228, 231, 347, 261; 206/205, 204; 428/64

[56] References Cited

U.S. PATENT DOCUMENTS

| | | | |
|---|---|---|---|
| 2,411,012 | 11/1946 | Wallach | 215/347 |
| 3,035,730 | 5/1962 | Walker | 215/228 |
| 3,254,784 | 6/1966 | Lancesseur | 215/228 |
| 3,326,401 | 6/1967 | De Long | 215/261 X |
| 3,670,874 | 6/1972 | Brunner | 206/205 |
| 3,712,848 | 1/1973 | Casey | 229/3.5 MF |
| 3,963,845 | 6/1976 | Dukess | 428/64 |

*Primary Examiner*—Donald F. Norton

*Attorney, Agent, or Firm*—Charles L. Lovercheck

[57] ABSTRACT

An oxygen-scavenging system for use in a closure for containers is disclosed. The system is in the form of a closure liner that incorporates a catalyst disposed between an oxygen permeable barrier and a water absorbent backing member. The backing member rests against the inside of the closure and the oxygen permeable barrier rests against the mouth of the container and the catalyst is sandwiched between the backing member and the barrier. The backing member may be porous and the closure may be perforated to allow water to escape.

23 Claims, 3 Drawing Figures

CLOSURE WITH OXYGEN SCAVENGING SYSTEM

GENERAL DESCRIPTION OF THE INVENTION

Many products such as drugs deteriorate and may become dangerous due to a chemical reaction with oxygen. While their containers may be evacuated or filled with inert gas when packaged, once opened the package fills with air and the product is exposed to the oxygen of the air. The present disclosure incorporates an oxygen-scavenging system in a closure for such container for use with products that cannot tolerate oxygen.

Films of an oxygen permeable selective barrier are available. Also, catalysts which react with oxygen to form moisture are available and known to those skilled in the art. For example, U.S. Pat. No. 3,712,874 discloses a package with a lining made of oxygen permeable, water impermeable material together with several layers of materials of various characteristics. According to the present invention, a film of oxygen-permeable ionomer is supported in contact with the interior of the container and its contents while next to the film is a layer of material containing a catalyst and a resilient backing member is added for sealing purposes. If required to retain moisture resulting from the reaction, an impermeable film may be added. The resilient backing member added for sealing purposes. In another embodiment, the impermeable film is not used and the backing material is porous and the closure may be perforated. This system continuously removes oxygen from the container.

REFERENCE TO PRIOR ART

U.S. Pat. No. 3,712,848 shows a flexible package with an inner permeable layer, a catalyst layer and an outer impermeable barrier. Applicant has provided a system in the form of a laminate especially for use with closures for use in rigid and semi-rigid containers.

U.S. Pat. Nos. 2,675,093; 2,514,902; 3,142,159; 3,870,492 and 4,029,955 show various apparatuses for collecting contamination from containers, but none of these references show such an apparatus in the form of a closure liner.

OBJECTS OF THE INVENTION

It is an object of the invention to provide an improved closure for a container.

Another object of the invention is to provide a combination closure and oxygen-scavenging system.

Another object of the invention is to provide an improved cap for a container and liner which incorporates an oxygen-scavenging system.

Another object of the invention is to provide an improved container cap.

With the above and other objects in view, the present invention consists of the combination and arrangement of parts hereinafter more fully described, illustrated in the accompanying drawing and more particularly pointed out in the appended claims, it being understood that changes may be made in the form, size, proporations and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
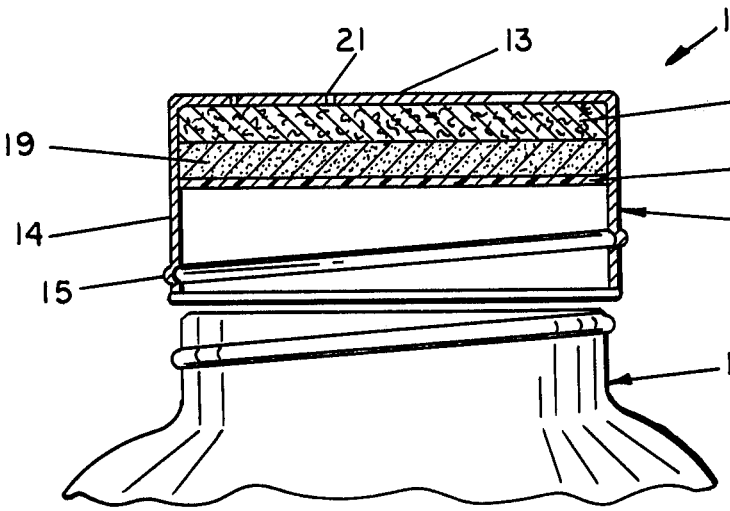
FIG. 1 is a longitudinal cross-sectional view of a container closure according to the invention.

Now, with more particular reference to the drawings, the embodiment of the invention shown in FIG. 1 shows a combination container and closure indicated generally at 10. The combination includes a closure in the form of a cap 11 and a container 12. The closure may be made of plastic, metal or any other suitable material, shown by way of example generally in the form of a cup-like member having a closed end 13 and rim 14 terminating in the threaded end 15 which engages thread around the mouth of the container 12. Instead of the threads shown suitable lugs, ribs, childproof fastening or other techniques familiar to those skilled in the art could be used for attaching the closure 10 to the container 12.

Inside the closure is the oxygen-scavenging system 17. This system 17 is in the form of a circular liner and it fits snuggly in the cap 11. The system is made up of a film of oxygen permeable material indicated generally at 17, a resilient backing member 18 which may be made of a material suitable for retaining water moisture or it could be water impervious which is sufficiently resilient for the purpose. Between the backing member 18 and the film 17 is disposed a layer of catalyst material 19. The barrier layer 17 and the catalyst material 19 could be constructed of a material like the corresponding catalyst layer in U.S. Pat. No. 3,712,848 or it could be any one of a variety of other suitable catalyst materials.

The preferred composition of the catalyst is palladium either in finely divided form such as palladium black or in the form of a thin coating on a carrier such as finely divided alumina. Palladium is preferred as the redox catalyst for economic reasons, but it will be obvious to those skilled in the art that equivalent substances such as the other platinum group metals or organic tin compounds can be substituted therefor.

Barrier layer 18 may be made of a resinous plastic material such as polyethylene but this layer may be formed from any equivalent material for example polypropylene or various other suitable ployolenns, cellophane, ployvinyl chloride, rubber hydrochloride, or wax-copolymer blends, such as blends of wax and ethylene-vinyl acetate copolymers that are oxygen permeable.

Oxygen from air trapped in the container 12 permeates or pass through the oxygen permeable film member 17 and combine with hydrogen in the catalyst layer 19 and since the layer 17 is impermeable to water, the oxygen now a component of water cannot return to the container and is retained there by the impermeable layer 17. The water resulting from the reaction is then absorbed by the backing material and can be dissipated if necessary through the perforations 21 in the closure 11.

Figure 2:
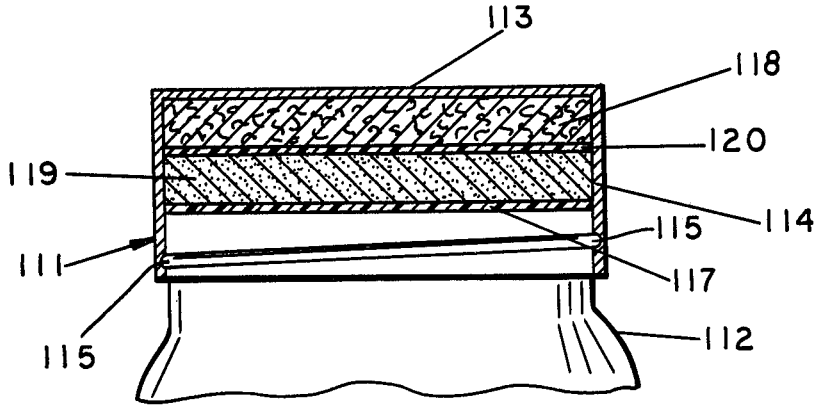
FIG. 2 is a longitudinal cross-sectional view of another embodiment of the invention.

In the embodiment of the invention shown in FIG. 2 which is similar to that shown in FIG. 1 with the addition of a water impermeable film layer 120 to retain moisture in the container when required by the contents. This closure is suitable for products which require the package to be reopened such as aspirin, as the oxygen removal action is continuously available. In contrast, a package using an inert gas to protect a product loses its protection when opened. The closure described is applied to product fillers with all components in place, ready for application. This is an advantage over loose packets of dessicant and the like currently used.

In the embodiment shown in FIG. 2 a closure 111 with a closed end 113 and side walls 114 and the liner is made up of a layer of oxygen permeable material 117 and water impermeable film 120 with a catalyst 119 therebetween. A resilient backing member 118 is supported behind the impermeable film 120. Thus, oxygen from air trapped in the container pass through the oxygen permeable barrier 117 and reacts with the catalyst 119 forming water. This water is retained in layer 119 by the impermeable film 120 and resilient member 118 provides a force holding film 117 to the mouth of container 12 forming a seal.

Figure 3:
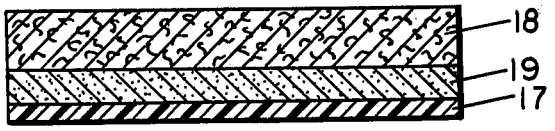
FIG. 3 is a longitudinal cross-sectional view of the liner of FIG. 1.

In the liner of the invention such as the liner 16 shown in FIGS. 1 and 3, the film 17 is permeable to oxygen and the backing member 18 is water absorbent. Catalyst layer 19 is sandwiched between layer 17 and 18. The liner can be used with a perforated cap as in FIG. 1 or with a sealed cap. This liner will retain the water found in the liner.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a closure and a liner comprising, a cup-like closure body having a closed end and a rim means on said closure body for removably attaching said closure to a container, a liner in said cup-like closure body, said liner comprising an oxygen permeable barrier layer adapted to rest on the open end of said container and a backing layer adapted to rest against the closed end of said closure and a layer of catalytic material disposed between said barrier and said backing and adapted to convert oxygen permeating said barrier layer to water.

2. The combination recited in claim 1 wherein said liner is generally cylindrical in shape and fits snuggly inside said closure.

3. The closure recited in claim 2 wherein said closure body has thread means thereon for attaching it to a container.

4. The combination recited in claims 1 or 2 wherein said backing layer is water absorbent.

5. The combination recited in claim 4 wherein said closed end is perforated.

6. The combination recited in claims 1 or 2 wherein said closure body is perforated and said backing layer is water absorbent.

7. The closure recited in claim 6 wherein said closure is perforated.

8. The combination recited in claims 1 or 2 wherein a second barrier layer is disposed between said backing layer and said catalytic material, said second barrier layer being impervious to water.

9. The closure recited in claim 8 wherein said backing layer is water absorbent.

10. The combination recited in claims 1 or 2 wherein said means for attaching said closure to said container comprises internal thread for attachment to external thread means on said container.

11. The combination recited in claim 1 wherein said backing layer is resilient.

12. The combination recited in claims 1 or 11 wherein said means for attaching said closure to said container comprises internal thread means on said closure for attachment to external thread means on said container.

13. The combination recited in claims 1 or 4 wherein said closed end is perforated.

14. The closure and liner recited in claim 1 wherein a water impermeable film is supported between said catalytic and said backing member.

15. The closure recited in claim 1 wherein said backing layer is water absorbent.

16. The closure recited in claim 1 wherein said oxygen permeable barrier is also permeable to water for allowing water formed from oxygen by said catalytic material to be returned to said container.

17. A liner for a closure comprising, a cylindrical disc-like member adapted to be received in a container closure, said liner comprising an oxygen permeable barrier layer adapted to rest on the open end of said container and a backing layer adapted to rest against the closed end of said closure and a layer of catalytic material disposed between said barrier and said backing and adapted to convert oxygen permeating said barrier layer to water.

18. The combination recited in claim 17 wherein said liner is generally cylindrical in shape and adapted to fit snuggly inside said closure.

19. The combination recited in claims 17 or 18 wherein said backing layer is water absorbent.

20. The combination recited in claims 17 or 18 in combination with a closure having a closure body wherein said closure body is perforated and said backing layer is water absorbent.

21. The combination recited in claims 17 or 18 wherein a second barrier layer is disposed between said backing member and said catalytic material, said second barrier layer being impervious to water.

22. The combination recited in claim 17 or 18 wherein said backing layer is resilient.

23. A container closure comprising, a gas impermeable generally cylindrical body closed at one end and a thread means on said closure for attaching it to a container, an oxygen scavenging system in said closure, said oxygen scavenging system comprising an oxygen permeable barrier, a backing member and a layer of catalytic material between said oxygen permeable barrier and said backing member, said scavenging system being in the form of a round disc attached on the inside of said closure.

* * * * *

UNITED STATES PATENT AND TRADEMARK OFFICE

CERTIFICATE OF CORRECTION

PATENT NO. : 4,279,350

DATED : JULY 21, 1981

INVENTOR(S) : RODERICK V. KING

It is certified that error appears in the above—identified patent and that said Letters Patent is hereby corrected as shown below:

Column 2, line 50 reads "ployolenns"

should read --polyolefins--

Column 2, line 51 reads "ployvinyl"

should read --polyvinyl--

Column 3, line 7 reads "dessicant"

should read --desiccant--

Column 4, line 17 reads "in claims 1 or 4"

should read --in claims 1 or 11--

Signed and Sealed this

First Day of June 1982

[SEAL]

Attest:

GERALD J. MOSSINGHOFF

Attesting Officer

Commissioner of Patents and Trademarks